US008100109B2

(12) United States Patent
Nakata

(10) Patent No.: US 8,100,109 B2
(45) Date of Patent: Jan. 24, 2012

(54) CONTROL DEVICE FOR IN-CYLINDER INJECTION INTERNAL COMBUSTION ENGINE

(75) Inventor: Shingo Nakata, Kariya (JP)

(73) Assignee: Denso Corporation, Kariya (JP)

( * ) Notice: Subject to any disclaimer, the term of this patent is extended or adjusted under 35 U.S.C. 154(b) by 303 days.

(21) Appl. No.: 12/607,389

(22) Filed: Oct. 28, 2009

(65) Prior Publication Data

US 2010/0101536 A1 Apr. 29, 2010

(30) Foreign Application Priority Data

Oct. 29, 2008 (JP) ..... 2008-278770

(51) Int. Cl.
*F02M 59/36* (2006.01)
*F02M 57/02* (2006.01)
*F02M 59/46* (2006.01)

(52) U.S. Cl. ..... 123/446; 123/467; 123/458; 701/112

(58) Field of Classification Search ..... 123/458, 123/467, 446–447, 497, 198 D, 198 DB; 701/112

See application file for complete search history.

(56) References Cited

U.S. PATENT DOCUMENTS

| | | | | |
|---|---|---|---|---|
| 5,651,347 | A * | 7/1997 | Oi et al. | 123/487 |
| 6,367,455 | B2 * | 4/2002 | Hirata et al. | 123/497 |
| 6,382,184 | B2 * | 5/2002 | Nakamura et al. | 123/464 |
| 6,868,826 | B1 * | 3/2005 | Oono | 123/339.1 |
| 7,066,152 | B2 * | 6/2006 | Stroia et al. | 123/467 |
| 7,284,539 | B1 * | 10/2007 | Fukasawa et al. | 123/506 |
| 7,565,898 | B2 * | 7/2009 | Fukasawa | 123/446 |
| 7,762,234 | B2 * | 7/2010 | Ulrey et al. | 123/456 |
| 7,801,672 | B2 * | 9/2010 | Ueda | 701/112 |
| 2007/0028897 | A1 | 2/2007 | Fukasawa | |

* cited by examiner

*Primary Examiner* — Thomas Moulis
(74) *Attorney, Agent, or Firm* — Nixon & Vanderhye PC

(57) ABSTRACT

A control device is for an in-cylinder injection engine that makes fuel have high pressure through a high pressure pump to supply fuel to an injector and then injects fuel directly into a cylinder from the injector. The control device includes a fuel pressure detecting device for detecting pressure of fuel supplied to the injector, a target fuel pressure setting device for setting a target fuel pressure according to an engine operating state, a fuel pressure control device for feedback-controlling a fuel discharge amount from the pump such that fuel pressure detected by the detecting device accords with the target fuel pressure, a stop predicting device for determining whether the engine is about to stop, and a target fuel pressure gradual change device for decreasing the target fuel pressure gradually to a final target fuel pressure lower than normal, when it is determined that the engine is about to stop.

4 Claims, 7 Drawing Sheets

CONTROL DEVICE FOR IN-CYLINDER INJECTION INTERNAL COMBUSTION ENGINE

CROSS REFERENCE TO RELATED APPLICATION

This application is based on and incorporates herein by reference Japanese Patent Application No. 2008-278770 filed on Oct. 29, 2008.

BACKGROUND OF THE INVENTION

1. Field of the Invention

The present invention relates to a control device for an in-cylinder injection internal combustion engine that makes fuel have high pressure through a high pressure pump to supply fuel to an injector and then injects fuel directly into a cylinder from the injector.

2. Description of Related Art

In an in-cylinder injection engine that injects fuel directly into a cylinder, a time from injection to combustion is short as compared to an intake port-injection engine that injects fuel into an intake port, so that enough time for atomizing the injected fuel cannot be gained. Accordingly, the injected fuel needs to be atomized by increasing injection pressure. For this reason, as described in JP-A-10-331734 (for example, p. 3), in the in-cylinder injection engine, fuel, which has been pumped-up by a low pressure pump from a fuel tank, is made to have high pressure through a high pressure pump that is driven by a cam shaft of the engine so as to be pressure-fed to an injector.

With respect to behavior of fuel pressure in a high pressure fuel pipe from this high pressure pump to the injector after the engine stops, fuel temperature rises in accordance with a rise of engine temperature due to residual heat of the engine and thereby the fuel pressure increases for a short while immediately after the engine stops. After that, in accordance with gradual decrease of the engine temperature due to heat release so that the fuel temperature is gradually reduced, the fuel pressure is gradually reduced. Moreover, in the in-cylinder injection engine, the fuel pressure is controlled to be a high pressure (e.g., about 8 MPa), even when the engine is in idle operation immediately before the engine stops. Therefore, coupled with the fuel pressure behavior after the engine stops as above, a period during which the fuel pressure is kept high after the engine stops becomes long. In addition, as the fuel pressure while the engine is at a stop is higher, an amount (oil tight amount) of fuel which leaks out of the injector becomes larger. Because of these circumstances, in the in-cylinder injection engine, the amount of fuel leakage while the engine is at a stop tends to be large as compared to the intake port-injection engine whose injected fuel pressure is low, and the leaked fuel accumulates in the cylinder so as to be discharged remaining unburned at the time of the following start-up of the engine, so that exhaust emission at the time of the start-up of the engine deteriorates.

As described in JP-A-2007-46482 (for example, pp. 2-4) corresponding to US2007/0028897A1, in order to solve this problem, it is proposed to decrease fuel pressure in the high pressure fuel pipe immediately before the stop of the internal combustion engine by determining whether the internal combustion engine is about to stop based on at least one of an idle operation command, an operative position of a shift lever, and a vehicle speed and then by setting a target fuel pressure on a lower-pressure side than usual if it is determined that the engine is about to stop.

However, according to the technology of JP-A-2007-46482, when it is determined that the internal combustion engine is about to stop, the target fuel pressure is reduced in a stepwise fashion. Therefore, a difference (hereinafter referred to as "fuel pressure difference") between actual fuel pressure (fuel pressure detected by a fuel pressure sensor) and target fuel pressure increases in a stepwise fashion immediately after the reduction of target fuel pressure. Therefore, in the fuel pressure control system that feedback-controls a discharge amount of the high pressure pump based on the fuel pressure difference to feedback-control fuel pressure, the fuel pressure difference, which is increased in a stepwise fashion immediately after the reduction of target fuel pressure, is accumulated and the integral term of the feedback control negatively becomes excessively large. As a result, undershoot is generated so that the actual fuel pressure falls to well below the reduced target fuel pressure. Accordingly, the actual fuel pressure may become too low so as to worsen combustion, and exhaust emission may deteriorate.

SUMMARY OF THE INVENTION

The present invention addresses the above disadvantages. Thus, it is an objective of the present invention to provide a control device for an in-cylinder injection internal combustion engine which avoids combustion deterioration and exhaust emission deterioration by limiting or preventing generation of undershoot, i.e., actual fuel pressure becomes lower than reduced target fuel pressure when control for reducing a target fuel pressure is carried out immediately before the engine stops.

To achieve the objective of the present invention, there is provided a control device for an in-cylinder injection internal combustion engine that makes fuel have high pressure through a high pressure pump to supply fuel to an injector and then injects fuel directly into a cylinder from the injector. The control device including a fuel pressure detecting means, a target fuel pressure setting means, a fuel pressure control means, a stop predicting means, and a target fuel pressure gradual change means. The fuel pressure detecting means is for detecting pressure of fuel that is supplied to the injector. The target fuel pressure setting means is for setting a target fuel pressure in accordance with an operating state of the engine. The fuel pressure control means is for feedback-controlling an amount of fuel discharged from the high pressure pump such that the pressure of fuel detected by the fuel pressure detecting means accords with the target fuel pressure. The stop predicting means is for determining whether the engine is about to stop. The target fuel pressure gradual change means is for decreasing the target fuel pressure gradually to a final target fuel pressure which is lower than normal, when it is determined by the stop predicting means that the engine is about to stop.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
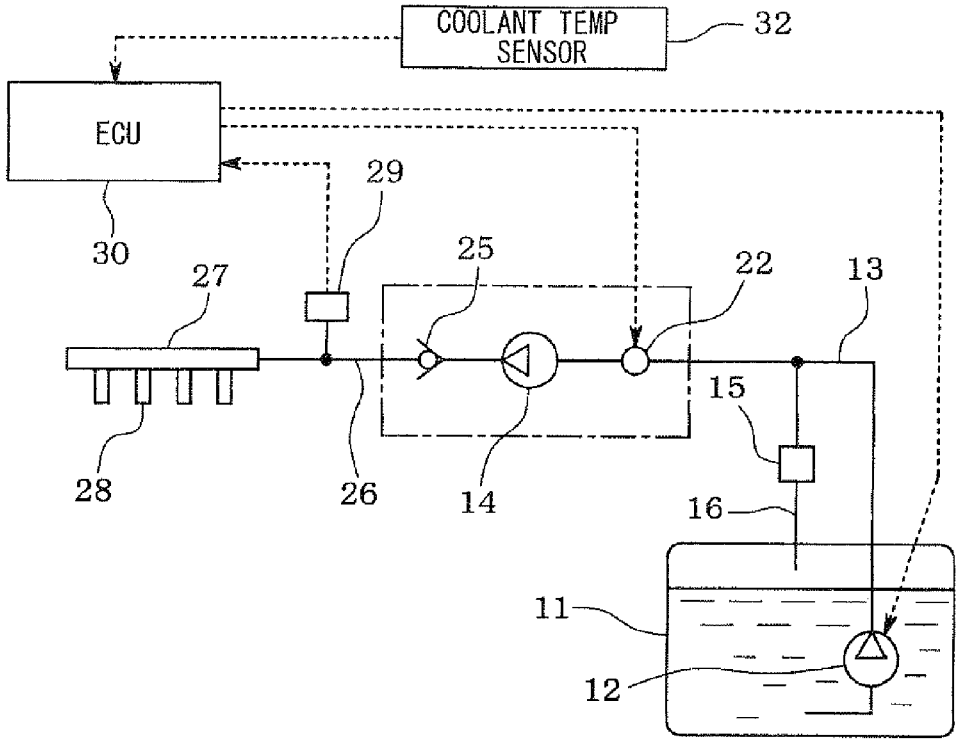
FIG. 1 is a diagram generally illustrating an overall constitution of a fuel injection system in accordance with first and second embodiments of the invention.

Embodiments of the invention are described below. The entire constitution of a fuel supply system for an in-cylinder injection (direct injection) engine (internal combustion engine) is explained with reference to FIG. 1.

A low pressure pump 12 for pumping up fuel is disposed in a fuel tank 11 for storing fuel. The low pressure pump 12 is driven by an electric motor (not shown) with a battery (not shown) serving as its power source. The fuel that is discharged from the low pressure pump 12 is supplied to a high pressure pump 14 through a fuel pipe 13. A pressure regulator 15 is connected to the fuel pipe 13. Discharge pressure of the low pressure pump 12 (fuel supply pressure to the high pressure pump 14) is regulated at a predetermined pressure by the pressure regulator 15, and surplus fuel in excess of the predetermined pressure is returned into the fuel tank 11 via a fuel-return pipe 16.

Figure 2:
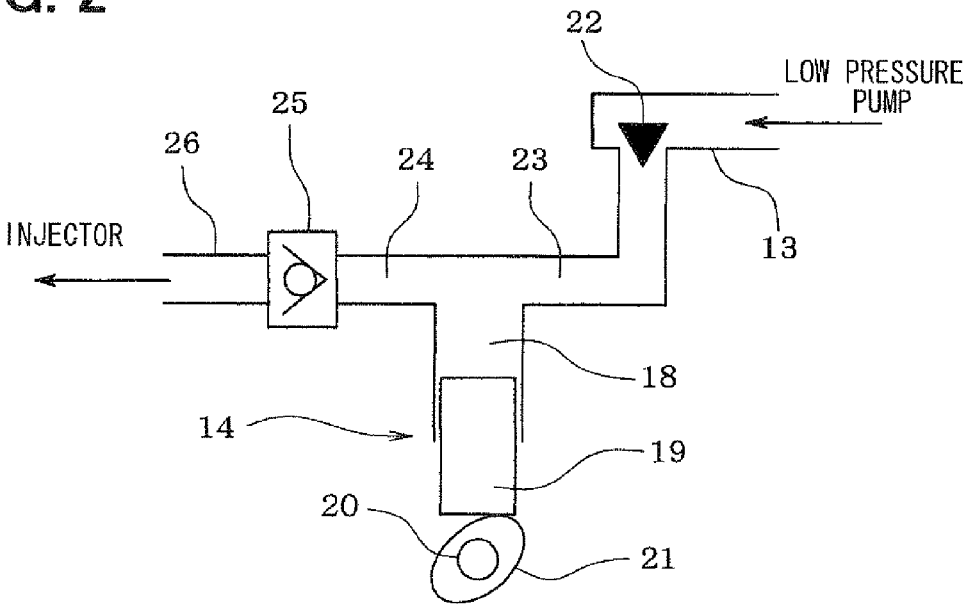
FIG. 2 is a configuration diagram illustrating a high pressure pump in accordance with the embodiments.

As shown in FIG. 2, the high pressure pump 14 is a piston pump that suctions/discharges fuel through the reciprocating movement of a piston 19 in a cylindrical pump room 18, and the piston 19 is driven through the rotation of a cam 21 fitted around a cam shaft 20 of the engine. A fuel pressure control valve 22 including a normally-open electromagnetic valve is provided on a suction port 23 side of the high pressure pump 14. During a suction stroke of the high pressure pump 14 (while the piston 19 is moving down), the fuel pressure control valve 22 is opened, so that fuel is suctioned into the pump room 18. During a discharging stroke (while the piston 19 is moving up), a discharge amount from the high pressure pump 14 is controlled by controlling a valve closing time of the fuel pressure control valve 22 (period of the valve-closing state from valve-closing start time to a top dead center of the piston 19). Accordingly, fuel pressure (discharge pressure) is controlled.

More specifically, when increasing the fuel pressure, the valve-closing start time (energizing time) of the fuel pressure control valve 22 is advanced so as to extend the valve closing time of the fuel pressure control valve 22 and thereby to increase the discharge amount from the high pressure pump 14. Conversely, when decreasing the fuel pressure, the valve-closing start time (energizing time) of the fuel pressure control valve 22 is delayed so as to reduce the valve closing time of the fuel pressure control valve 22 and thereby to decrease the discharge amount from the high pressure pump 14.

On the other hand, a check valve 25 for preventing a backflow of the fuel that has been discharged is provided on a discharge port 24 side of the high pressure pump 14. As shown in FIG. 1, the fuel that is discharged from the high pressure pump 14 is fed to a delivery pipe 27 through a high pressure fuel pipe 26, and then the high-pressure fuel is distributed to an injector 28, which is attached to a cylinder head of the engine for each cylinder, from the delivery pipe 27. A fuel pressure sensor 29 (fuel pressure detecting means) for detecting fuel pressure is provided for the high pressure fuel pipe 26, and a coolant temperature sensor 32 for detecting coolant temperature is provided for a cylinder block of the engine.

Outputs from these various sensors are inputted into an engine controlling circuit (hereinafter referred to as "ECU") 30. The ECU 30 mainly includes a microcomputer, and feedback-controls the discharge amount from the high pressure pump 14 (energizing time of the fuel pressure control valve 22) so that a fuel pressure detected by the fuel pressure sensor 29 (actual fuel pressure) may coincide with a target fuel pressure (this function may correspond to a "fuel pressure control means").

Meanwhile, by performing each routine for setting the target fuel pressure illustrated in FIG. 3 or FIG. 4 and FIG. 5 described in greater detail hereinafter, the ECU 30 determines whether the engine is about to stop based on at least one of an idle operation command, an operative position of a shift lever, and a vehicle speed, for example, and when it is determined that the engine is about to stop, the ECU 30 executes fuel pressure reduction control for gradually reducing the target fuel pressure to a final target fuel pressure which is lower than usual.

According to the above-described conventional technology (JP-A-2007-46482), when it is determined that the engine is about to stop, the target fuel pressure is decreased in a stepwise fashion. Therefore, a difference between actual fuel pressure and target fuel pressure (hereinafter referred to as "fuel pressure difference") increases in a stepwise fashion immediately after the reduction of target fuel pressure. Therefore, in the fuel pressure control system that feedback-controls a discharge amount of the high pressure pump based on the fuel pressure difference to feedback-control fuel pressure, the fuel pressure difference, which is increased in a stepwise fashion immediately after the reduction of target fuel pressure, is accumulated and the integral term of the feedback control negatively becomes excessively large. As a result, undershoot is generated so that the actual fuel pressure falls to well below the reduced target fuel pressure. Accordingly, the actual fuel pressure may become too low so as to worsen combustion, and exhaust emission may deteriorate.

Figure 3:
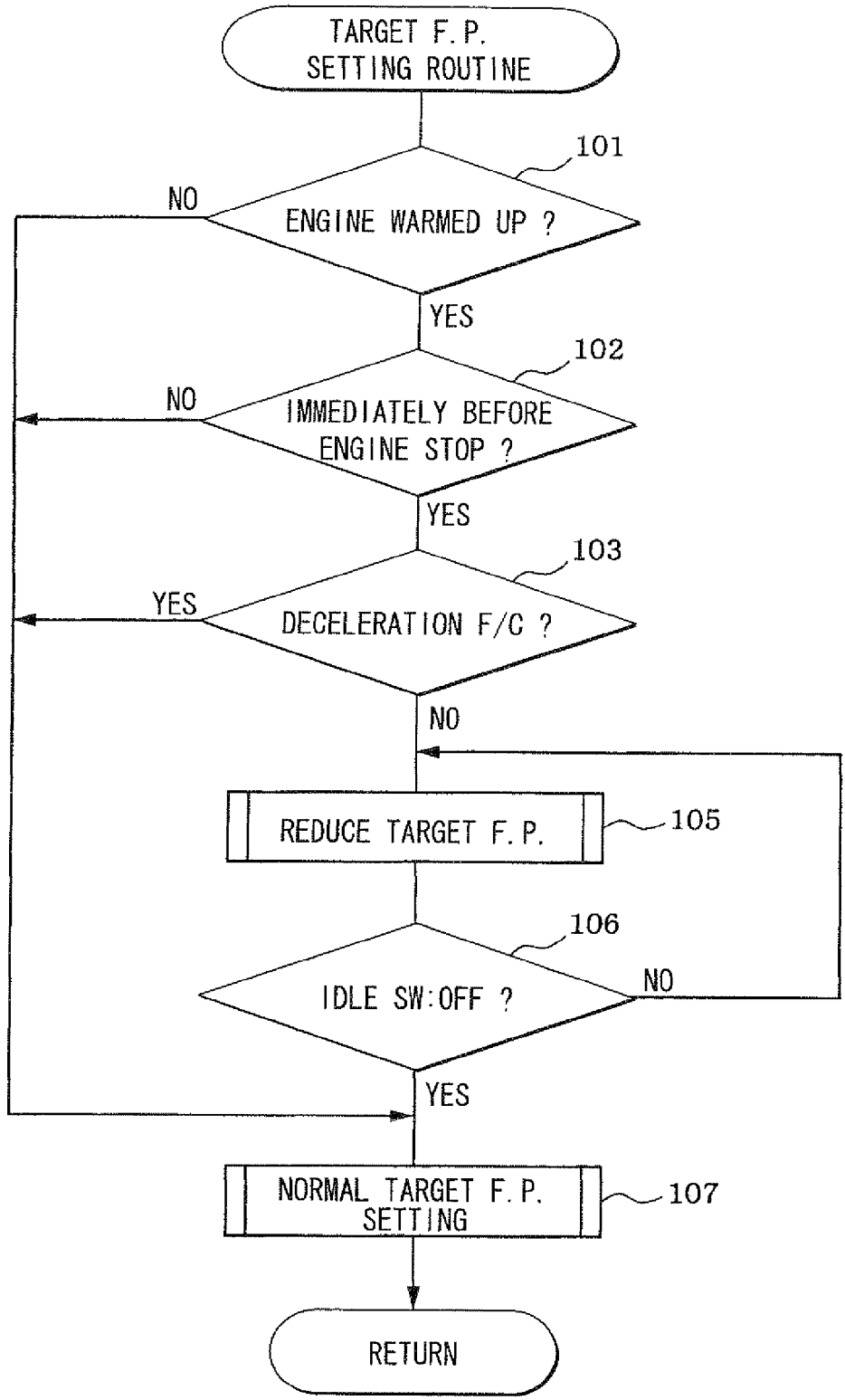
FIG. 3 is a flow chart illustrating a flow of processing of a target fuel pressure setting routine in accordance with the first embodiment.
Figure 4:
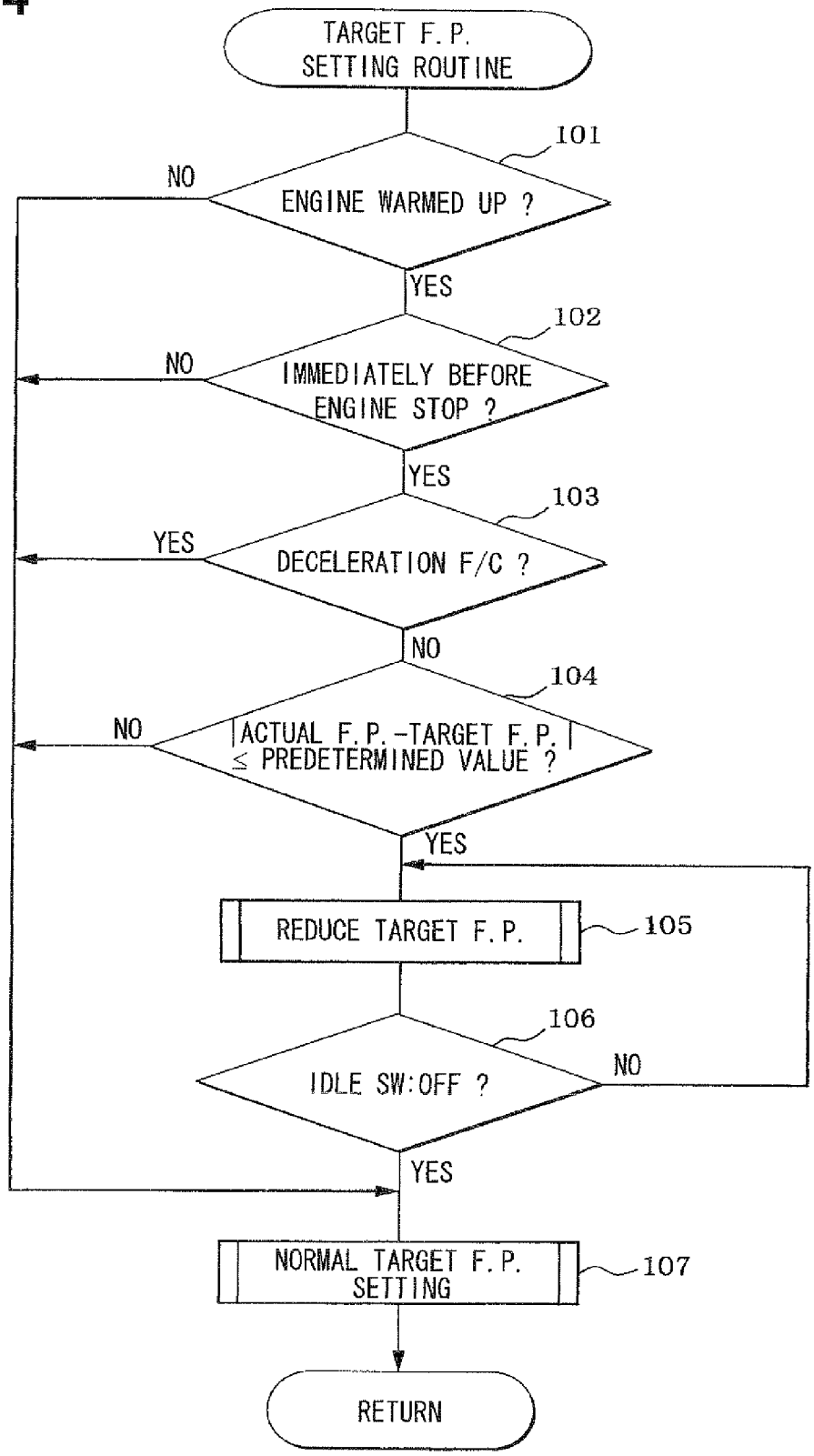
FIG. 4 is a flow chart illustrating a flow of processing of a target fuel pressure setting routine in accordance with the second embodiment.

As measures against this, in first and second embodiments when it is determined that the engine is about to stop, the target fuel pressure is gradually decreased to the final target fuel pressure which is lower than normal through a target fuel pressure setting routine in FIG. 3 and FIG. 4. Therefore, a difference between the actual fuel pressure (fuel pressure detected by the fuel pressure sensor 29) and the target fuel pressure when reducing the target fuel pressure is smaller than the above conventional technology, and an absolute value of the integral term in the feedback control is smaller than the conventional technology. Accordingly, when the control for reducing the target fuel pressure is carried out immediately before the engine stop, the generation of undershoot, i.e., the actual fuel pressure becomes lower than the reduced target fuel pressure, is limited or prevented, and combustion deterioration and exhaust emission deterioration are avoided.

Figure 8:
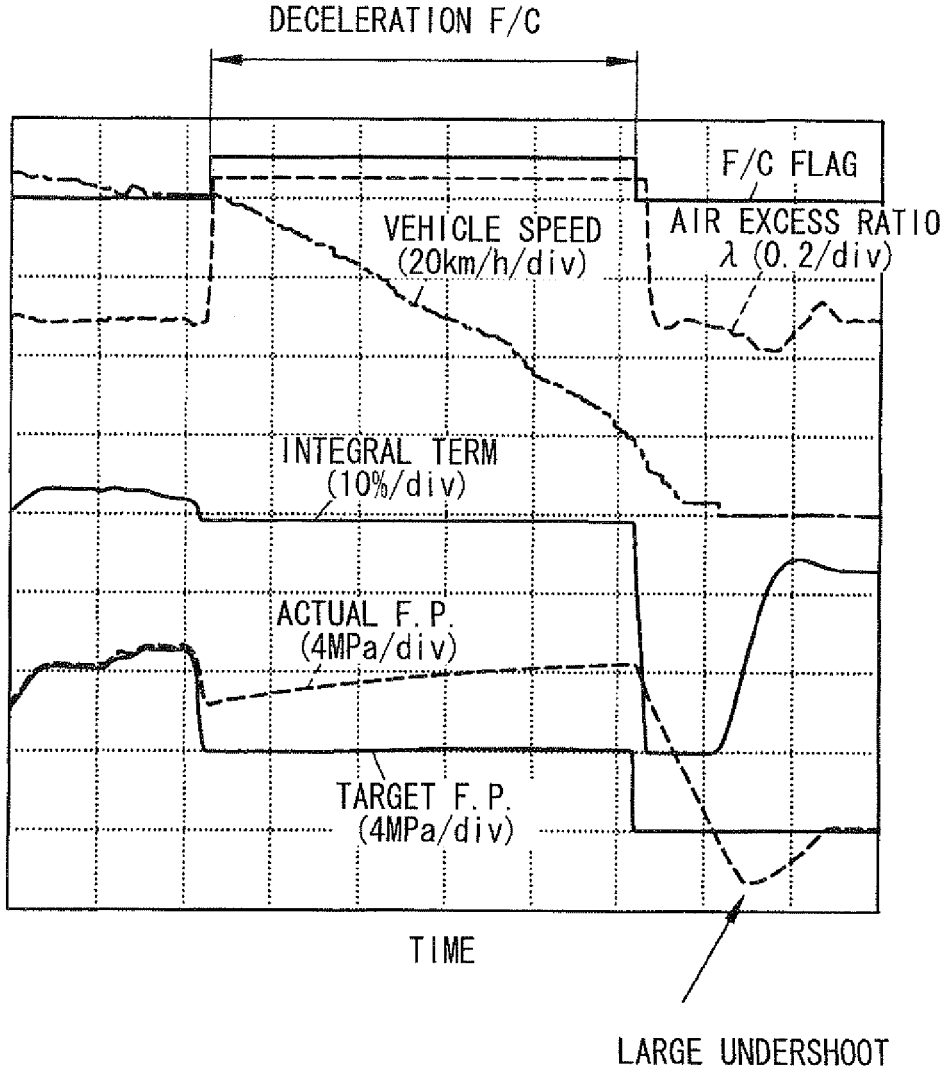
FIG. 8 RELATED ART
FIG. 8 is a timing diagram illustrating behavior of fuel pressure reduction control immediately before an engine stops in accordance with a comparative example.

In a comparative example shown in FIG. 8, if it is determined that an engine is about to stop while carrying out deceleration fuel cut ("fuel cut" is indicated by "F/C" in the drawings), a target fuel pressure is reduced in a stepwise fashion after the return from the deceleration fuel cut. Fuel injection is stopped while the deceleration fuel cut is in execution, so that fuel in a high pressure fuel system on a discharge side of the high pressure pump cannot be reduced. Therefore, the fuel pressure cannot be reduce despite the reduction of target fuel pressured.

In view of this, in the comparative example shown in FIG. 8, if it is determined that an engine is about to stop while the deceleration fuel cut is in execution, the target fuel pressure is reduced in a stepwise fashion after the return from the deceleration fuel cut (after resumption of fuel injection). However, as a result of the stepwise reduction of the target fuel pressure, a difference (fuel pressure difference) between actual fuel pressure (fuel pressure detected by a fuel pressure sensor) and target fuel pressure increases in a stepwise fashion. Accordingly, the large fuel pressure difference is accumulated and the integral term of the feedback control negatively becomes excessively large. As a result, undershoot is generated so that the actual fuel pressure falls to well below the reduced target fuel pressure. Consequently, the actual fuel pressure becomes too low. Therefore, combustion deteriorates and exhaust emission worsens.

Figure 5:
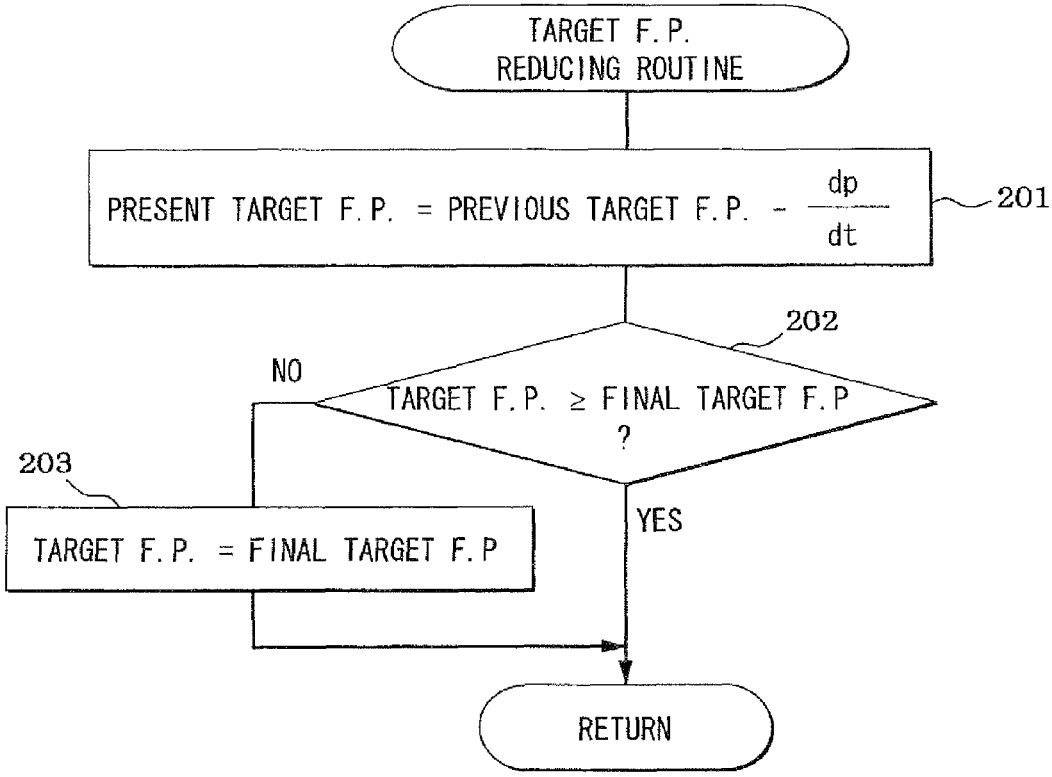
FIG. 5 is a flow chart illustrating a flow of processing of a target fuel pressure reducing routine in accordance with the first and second embodiments.

For this reason, in the first embodiment of the invention, by performing each routine for setting the target fuel pressure in FIG. 3 and FIG. 5, when it is determined that the engine is about to stop, the fuel pressure reduction control for gradually decreasing the target fuel pressure to the final target fuel pressure which is lower than normal is started if the deceleration fuel cut is not in execution, whereas the fuel pressure reduction control is started after the return from the deceleration fuel cut if the deceleration fuel cut is in execution.

Processing of each routine for setting the target fuel pressure in FIG. 3 and FIG. 5 executed by the ECU 30 is explained below. The target fuel pressure setting routine in FIG. 3 is performed at predetermined intervals while a power source of the ECU 30 is turned on. When this routine is started, it is first determined at Step 101 whether the engine has been warmed up based on water temperature detected by the coolant temperature sensor 32, for example, and if the engine has not been warmed up (if the engine is in warm-up operation), control proceeds to Step 107 so as to execute a normal target fuel pressure setting routine (not shown). Accordingly, the target fuel pressure is set in accordance with an engine operating state (i.e., the target fuel pressure in accordance with the engine warm-up operation is set if the engine is in warm-up operation). The processing at Step 107 may function as a "target fuel pressure setting means."

If it is determined at Step 101 that the engine has been warmed up, control proceeds to Step 102 so as to determine whether the engine is about to stop. At Step 102, using the determination method described in JP-A-2007-46482, for example, whether the engine is about to stop may be determined based on at least one of the idle operation command, the operative position of the shift lever, and the vehicle speed. The processing at Step 102 may function as a "stop predicting means." If it is determined at Step 102 that the engine is not about to stop, control proceeds to Step 107 so as to execute a normal target fuel pressure setting routine (not shown), and the target fuel pressure in accordance with the engine operating state is set.

If it is determined at Step 102 that the engine is about to stop, control proceeds to Step 103 so as to determine whether the deceleration fuel cut is in execution. If the deceleration fuel cut is in execution, control proceeds to Step 107 so as to execute a normal target fuel pressure setting routine (not shown), without performing target fuel pressure reduction processing at Step 105 even though it has been determined that the engine is about to stop.

Upon return from the deceleration fuel cut, control proceeds from Step 103 to Step 105 to carry out a target fuel pressure reducing routine illustrated in FIG. 5 described in greater detail hereinafter, and the fuel pressure reduction control for gradually reducing the target fuel pressure to the final target fuel pressure which is lower than normal is performed.

While the fuel pressure reduction control is in execution, whether an idle switch is turned off (i.e., whether an accelerator pedal is depressed) is monitored at Step 106. When the idle switch is turned off (i.e., when it has turned out that the engine is not about to stop), the fuel pressure reduction control is stopped and control proceeds to Step 107 so as to execute a normal target fuel pressure setting routine (not shown), and the target fuel pressure in accordance with the engine operating state is set.

The target fuel pressure reducing routine illustrated in FIG. 5 is a subroutine executed at Step 105 in FIG. 3 (FIG. 4), and may serve as a "target fuel pressure gradual change means." When this routine is started, at Step 201, a value obtained as a result of the subtraction of a fuel pressure decrease amount per an operation period dP/dt from a previous target fuel pressure is set at a present target fuel pressure.

$$\text{present target fuel pressure} = \text{previous target fuel pressure} - dP/dt$$

The fuel pressure decrease amount per an operation period dP/dt is set based on a fuel consumption amount of the engine per unit time ΔV (=the number of injections per unit time× fuel injection quantity) and volume V of a high pressure fuel system on a discharge side of the high pressure pump 14 (high pressure fuel pipe 26 and delivery pipe 27). For example, the target fuel pressure may be gradually reduced by a fuel pressure decrease amount per unit time ΔV/V during the fuel pressure reduction control. Accordingly, the actual fuel pressure is reduced, following the decreasing target fuel pressure in a highly-responsive manner. Therefore, the fuel pressure decrease amount per an operation period dP/dt may be calculated from the fuel pressure decrease amount per unit time ΔV/V using the following equation:

$$dP/dt = (\Delta V/V) \times (\text{operation period/unit time})$$

After this, control proceeds to Step 202 to determine whether the target fuel pressure, which has been subtracted at Step 201, is equal to or greater than the final target fuel pressure in the fuel pressure reduction control. The final target fuel pressure in the fuel pressure reduction control may be set at within a range of fuel pressure that is lower than a target fuel pressure (e.g., 8 MPa) when the engine is in normal idle operation (e.g., in a range of 1 to 6 MPa, or 2 to 4 MPa). In the first embodiment, the final target fuel pressure is set at, for example, 3 MPa.

If it is determined at Step 202 that the target fuel pressure is equal to or greater than the final target fuel pressure, the present routine is ended. If it is determined that the target fuel pressure is lower than the final target fuel pressure, control proceeds to Step 203 to set the target fuel pressure at the final target fuel pressure. By repeating the above-described processing with a predetermined operation period, the target fuel pressure is gradually reduced to the final target fuel pressure which is lower than normal, by the fuel pressure decrease amount per an operation period dP/dt, and after the target fuel pressure has been reduced to the final target fuel pressure, the target fuel pressure is maintained at the final target fuel pressure.

Figure 6:
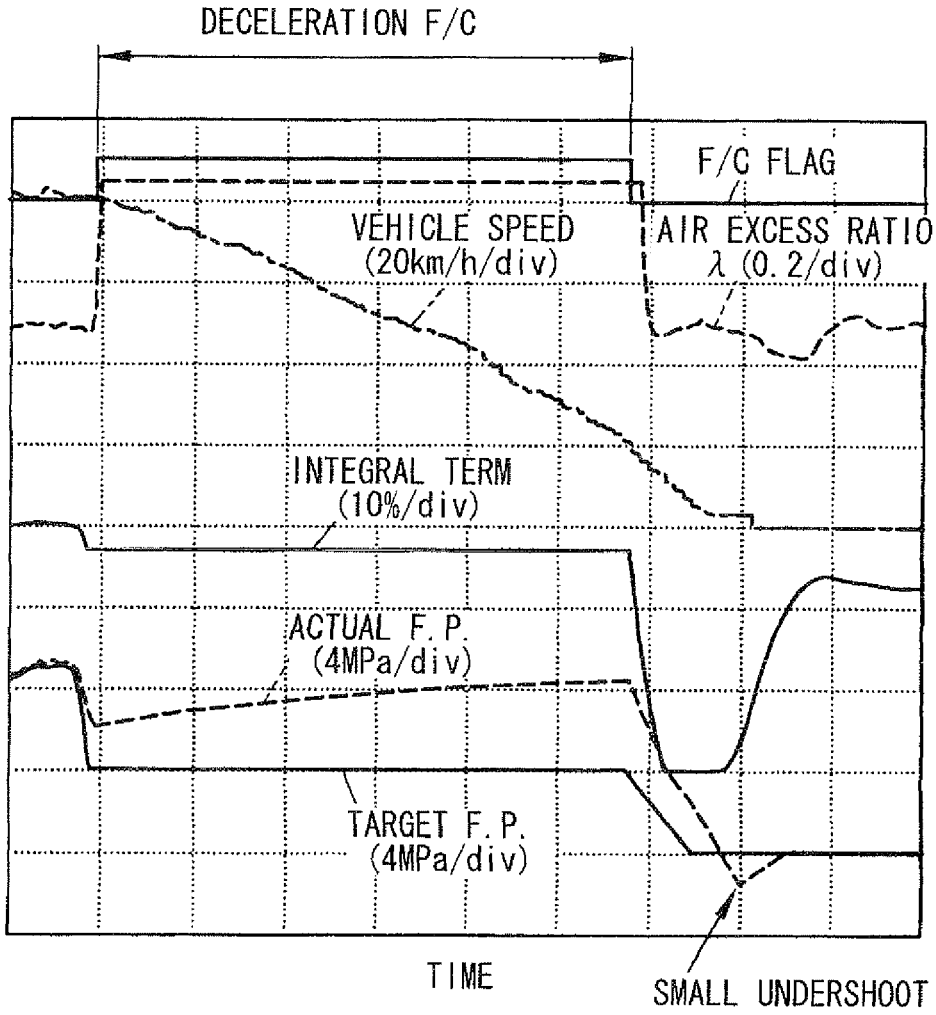
FIG. 6 is a timing diagram illustrating behavior of fuel pressure reduction control immediately before an engine stops in accordance with the first embodiment.

In the above-described first embodiment, as shown in FIG. 6, when it is determined that the engine is about to stop, the fuel pressure reduction control for gradually decreasing the target fuel pressure is started after the return from the deceleration fuel cut if the deceleration fuel cut is in execution. Accordingly, even when it is determined that the engine is about to stop while the deceleration fuel cut is in execution, the start of the fuel pressure reduction control while the deceleration fuel cut is in execution is prevented. Therefore, the generation of undershoot of fuel pressure after the return from the deceleration fuel cut is more reliably limited or prevented.

When the deceleration fuel cut is in execution, there is a characteristic that temperature of fuel in the high pressure fuel system gradually increases, so that the actual fuel pressure gradually rises, as illustrated in FIG. 6. Thus, a difference between actual fuel pressure and target fuel pressure may be great at the time of the return from the deceleration fuel cut (when fuel injection is resumed). For this reason, if the fuel pressure reduction control is started immediately upon return from the deceleration fuel cut, a small undershoot of fuel pressure may be produced.

Figure 7:
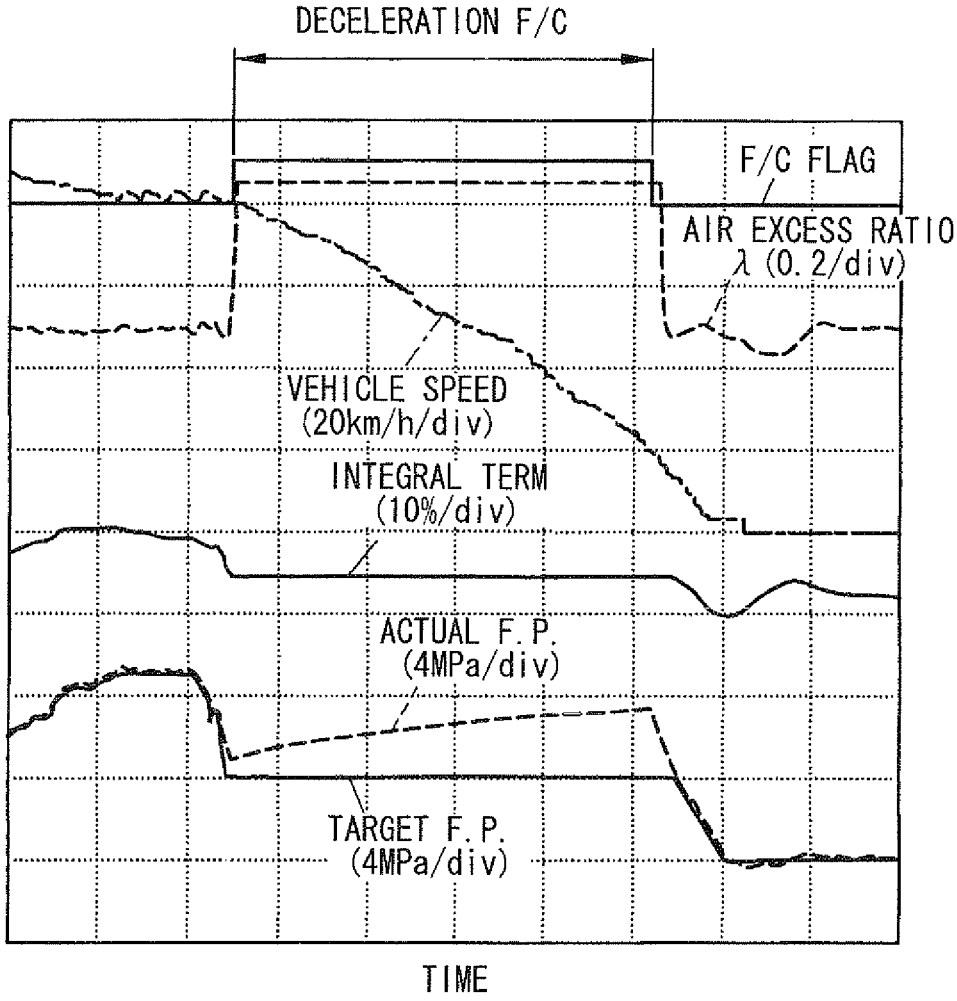
FIG. 7 is a timing diagram illustrating behavior of fuel pressure reduction control immediately before an engine stops in accordance with the second embodiment.

Accordingly, in the second embodiment illustrated in FIG. 4 and FIG. 7, if it is determined that an engine is about to stop, the fuel pressure reduction control for gradually decreasing the target fuel pressure is started after a difference between a fuel pressure detected by a fuel pressure sensor 29 (actual fuel pressure) and a target fuel pressure has fallen within a predetermined value.

A target fuel pressure setting routine in FIG. 4 is obtained by simply adding processing of Step 104 after Step 103 of the target fuel pressure setting routine in FIG. 3, and processing of other Steps is the same as the routine of FIG. 3. In the target fuel pressure setting routine in FIG. 4, provided that it is determined at Steps 101 to 103 that the engine has been warmed up and that the engine is just about stopping, if it is determined that the deceleration fuel cut is not being performed, control proceeds to Step 104 to determine whether the difference between the actual fuel pressure (fuel pressure detected by the fuel pressure sensor 29) and the target fuel pressure is within the predetermined value. The predetermined value is set at a value corresponding to an upper limit fuel pressure difference as long as fuel pressure is able to be controlled in a highly-responsive manner by feedback control.

If it is determined at Step 104 that the difference between actual fuel pressure and target fuel pressure is larger than the predetermined value, control proceeds to Step 107 so as to execute a normal target fuel pressure setting routine (not shown) without performing target fuel pressure reduction processing at Step 105 even though the engine has returned from the deceleration fuel cut.

Upon determination at Step 104 that the difference between actual fuel pressure and target fuel pressure is within the predetermined value, control proceeds from Step 104 to Step 105 to carry out a target fuel pressure reducing routine illustrated in FIG. 5, and the fuel pressure reduction control for gradually reducing the target fuel pressure to the final target fuel pressure which is lower than normal is performed.

In the above-described second embodiment, if it is determined that the engine is about to stop, the fuel pressure reduction control for gradually decreasing the target fuel pressure is started after a difference between a fuel pressure detected by a fuel pressure sensor 29 (actual fuel pressure) and a target fuel pressure has fallen within a predetermined value. Accordingly, as shown in FIG. 7, even though the engine has returned from the deceleration fuel cut, the fuel pressure reduction control is not started if the difference between actual fuel pressure and target fuel pressure is large. The control to start the fuel pressure reduction control after the difference between actual fuel pressure and target fuel pressure has become small within a range in which fuel pressure is able to be controlled in a highly-responsive manner by feedback control, is made possible. As a result, the generation of undershoot of fuel pressure is more reliably limited or prevented.

The invention is not limited to the above-described first and second embodiments. For example, if a state in which it is determined that the engine is just about to stop continues for more than a predetermined time, it may be determined that the engine is not just about to stop (a driver of the vehicle intends to continue the engine operation), and the fuel pressure may be returned to a normal target fuel pressure.

Furthermore, the invention may be embodied through its various modifications without departing from the scope of the invention, for example, a method of determination whether the engine is about to stop may be modified according to circumstances.

Additional advantages and modifications will readily occur to those skilled in the art. The invention in its broader terms is therefore not limited to the specific details, representative apparatus, and illustrative examples shown and described.

What is claimed is:

1. A control device for an in-cylinder injection internal combustion engine that makes fuel have high pressure through a high pressure pump to supply fuel to an injector and then injects fuel directly into a cylinder from the injector, the control device comprising:

a fuel pressure detecting means for detecting pressure of fuel that is supplied to the injector;

a target fuel pressure setting means for setting a target fuel pressure in accordance with an operating state of the engine;

a fuel pressure control means for feedback-controlling an amount of fuel discharged from the high pressure pump such that the pressure of fuel detected by the fuel pressure detecting means accords with the target fuel pressure;

a stop predicting means for determining whether the engine is about to stop; and a target fuel pressure gradual change means for decreasing the target fuel pressure gradually to a final target fuel pressure which is lower than normal, when it is determined by the stop predicting means that the engine is about to stop.

2. The control device according to claim 1, wherein provided that deceleration fuel cut into the cylinder is in execution when it is determined by the stop predicting means that the engine is about to stop, the target fuel pressure gradual change means starts to decrease the target fuel pressure gradually after the deceleration fuel cut is completed.

3. The control device according to claim 1, wherein:

the injector and a discharge side of the high pressure pump are connected through a high pressure fuel system; and a rate of decrease in the target fuel pressure when the target fuel pressure gradual change means decreases the target fuel pressure gradually is set based on a fuel consumption amount of the engine per unit time and volume of the high pressure fuel system.

4. The control device according to claim 1, wherein when it is determined by the stop predicting means that the engine is about to stop, the target fuel pressure gradual change means starts to decrease the target fuel pressure gradually after a difference between the pressure of fuel detected by the fuel pressure detecting means and the target fuel pressure falls within a predetermined value through the feedback-control by the fuel pressure control means.

* * * * *